US006532684B1

(12) United States Patent
Tunney et al.

(10) Patent No.: US 6,532,684 B1
(45) Date of Patent: Mar. 18, 2003

(54) SYSTEM FOR CLEANING PRESSURIZED CONTAINERS

(75) Inventors: Joseph P. Tunney, Evanston, IL (US); Paul Buchan, Regina (CA); Thomas J. Davis, Cary, IL (US); Raymond Blaine Vermette, Regina (CA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/901,521

(22) Filed: Jul. 9, 2001

Related U.S. Application Data

(63) Continuation-in-part of application No. 09/689,424, filed on Oct. 12, 2000, and a continuation-in-part of application No. 09/689,386, filed on Oct. 12, 2000, and a continuation-in-part of application No. 09/689,150, filed on Oct. 12, 2000, and a continuation-in-part of application No. 09/689,035, filed on Oct. 12, 2000.

(51) Int. Cl.[7] ..... F26B 7/00

(52) U.S. Cl. ..... 34/410; 34/437; 34/92; 34/104

(58) Field of Search ..... 34/284, 285, 286, 34/288, 289, 359, 360, 361, 362, 363, 402, 403, 404, 406, 407, 408, 409, 410, 437, 493, 92, 104, 605

(56) References Cited

U.S. PATENT DOCUMENTS

| | | | | | |
|---|---|---|---|---|---|
| 3,756,170 | A | | 9/1973 | Lang | |
| 3,873,745 | A | * | 3/1975 | Rey et al. | 426/319 |
| 4,098,303 | A | | 7/1978 | Gammell | |
| 4,469,143 | A | | 9/1984 | Vazin | |
| 4,492,558 | A | | 1/1985 | Schwartz et al. | |
| 4,523,854 | A | * | 6/1985 | Beckley | 366/132 |
| 4,582,100 | A | | 4/1986 | Poulsen | |
| 4,816,081 | A | * | 3/1989 | Mehta et al. | 134/30 |
| 5,002,101 | A | * | 3/1991 | McLeod | 141/83 |
| 5,017,240 | A | | 5/1991 | Brown | |
| 5,103,578 | A | * | 4/1992 | Rickard | 34/92 |
| 5,168,709 | A | | 12/1992 | Bombard | |
| 5,343,633 | A | * | 9/1994 | Wang et al. | 34/92 |
| 5,439,020 | A | * | 8/1995 | Lockhart | 137/3 |
| 5,489,166 | A | * | 2/1996 | Schmit | 406/137 |
| 5,513,446 | A | * | 5/1996 | Neubauer et al. | 34/397 |
| 5,513,680 | A | | 5/1996 | Hilliard, Jr. et al. | |
| 5,526,582 | A | * | 6/1996 | Isaksson | 34/476 |
| 5,551,165 | A | * | 9/1996 | Turner et al. | 34/404 |
| 5,584,939 | A | | 12/1996 | Dahlin | |
| 5,588,637 | A | * | 12/1996 | Carsten et al. | 251/129.03 |
| 5,591,272 | A | | 1/1997 | Hummer | |
| 5,647,143 | A | * | 7/1997 | Kubota et al. | 34/410 |
| 5,759,287 | A | * | 6/1998 | Chen et al. | 134/21 |
| 5,776,257 | A | | 7/1998 | Arnold et al. | |
| 5,813,849 | A | | 9/1998 | Schwartz et al. | |

(List continued on next page.)

*Primary Examiner*—Ira S. Lazarus
*Assistant Examiner*—K. B Rinehart
(74) *Attorney, Agent, or Firm*—McDermott, Will & Emery

(57) ABSTRACT

The present invention relates to a system for cleaning a pressurized container having at least one chemical contained therein. More specifically, the container may store a quantity of a chemical that is reactive with water and forms dangerous reaction products, such as, for example, acids. The pressurized container may be any type of container able to store chemicals under pressure. Preferably, however, the container may be a rail tank car. The system includes the container that may have a plurality of valves for adding or removing gaseous or liquid material to or from the container. The container may be connected with a nitrogen tank or a fan for blowing air that may be heated via a heater. A vacuum pump is utilized for removing the contents of the container. The container may further be connected to a reaction tank for neutralizing the chemical that is be removed from the container.

35 Claims, 8 Drawing Sheets

U.S. PATENT DOCUMENTS 5,947,141 A * 9/1999 Nuss ..... 137/3
6,033,901 A 3/2000 Powell, Jr.
6,041,793 A 3/2000 Miyasaki
6,158,146 A * 12/2000 Kieselbach et al. ..... 34/408
6,163,914 A * 12/2000 Martin ..... 15/1.7
6,203,623 B1 3/2001 Xia
6,249,990 B1 * 6/2001 Tannuos ..... 34/402
6,286,230 B1 * 9/2001 White et al. ..... 34/403
6,289,605 B1 * 9/2001 Chang ..... 34/471

* cited by examiner

SEARCH CONTAINER
10

1
EVIDENCE OF LEAKS ?
YES
NO
16
SAMPLE SIDE PORT AT DOME
EVIDENCE OF LEAKS ?
YES
NO
20
REMOVE PROTECTIVE FACEMASK FOR SNIFF TEST
EVIDENCE OF LEAKS ?
YES
24
NO
OPEN DOME COVER; INSPECT DOME AREA
PROCEED TO HEATED $N_2$ CLEANING
26
14
ASSESS LEAK; SUBMIT CONTAINER FOR REPAIRS

SYSTEM FOR CLEANING PRESSURIZED CONTAINERS

The present invention is a continuation-in-part of copending U.S. patent application Ser. No. 09/689,424 entitled "A System of Cleaning Pressurized Containers"; Ser. No. 9/689,386 entitled "A Method of Cleaning Pressurized Containers"; Ser. No. 09/689,150 entitled "A Method of Cleaning Pressurized Container Containing Liquid Petroleum Gas"; and Ser. No. 09/689,035 entitled "A Method of Cleaning Pressurized Containers Containing Anhydrous Ammonia". Each of these patent applications was filed on Oct. 12, 2000.

1. Field of Invention

The present invention relates to a system for cleaning pressurized containers having chemicals contained therein. Specifically, the present invention relates to a system for cleaning pressurized containers such as, for example, rail tank cars, mobile tanks or the like. Further, the chemicals may comprise any material stored under pressure that may be difficult to collect and dispose of due to the hazardous characteristics thereof. Moreover, the chemicals may further be highly reactive to moisture and may form damaging acids or other reaction products when contacting water.

2. Background of the Invention

It is, of course, generally known to store and/or transport chemicals having hazardous characteristics via pressurized containers. Further, it is also generally known to clean these containers using a variety of methods and systems. In the past, cleaning pressurized containers entailed venting excess gaseous material to the atmosphere. Further, unpressurized containers contained bottom hatches or valves for draining liquid chemicals. However, many hazardous chemicals escaped into the environment thereby causing health risks for humans, vegetation and wildlife. With the advent of environmental standards and compliance, however, venting or draining hazardous chemicals to the environment has generally become illegal.

Moreover, some chemicals that may be stored within pressurized containers may be highly reactive in the presence of water and may form acids that may be damaging to equipment as well as the environment. Although a flare may be useful to dispose of chemicals that are flammable, some chemicals do not incinerate easily or may form extremely hazardous substances upon incineration. Typically, scrubbers or sparge tanks are necessary to dispose of these chemicals or byproducts of these chemicals.

While some of the gases contained within the containers may be relatively easy to recover and dispose of by venting the pressurized containers to a flare or to a sparge tank, it is difficult to remove all of the gases contained therein. Further, liquid product may remain inside a container after cleaning. Typical systems and methods of cleaning pressurized containers may involve injecting the container with a quantity of steam that may aid in bringing the liquid chemicals to the gaseous phase and removing the steam/gaseous chemical product combination for incineration or disposal. However, problems may occur using steam to remove chemicals from pressurized containers since steam may condense within the container forming liquid water or ice. The liquid water or ice may mask the presence of the chemicals from detectors or otherwise encapsulate the chemicals. Further, the liquid water or ice may interfere with the removal of the chemicals from the container. Moreover, liquid water or steam may react with certain chemicals, such as for example, chlorine gas or sulfur dioxide gas to form hazardous byproducts, such as acids, that may damage equipment or the environment if released. For example, chlorine gas and sulfur dioxide gas may react with water according to the following reaction:

$$Cl_2+H_2O \rightarrow HCl+HOCl \quad 1.$$

$$2\ SO_2+2\ H_2O+O_2 \rightarrow 2\ H_2SO_4 \quad 2.$$

In addition, steam or liquid water may be difficult to remove from the container since water droplets may stick to the inside surfaces of the container, piping and/or equipment. A further step would be required for drying the container and/or the equipment, thereby requiring additional time, equipment and expense.

Another method of removal may include entering the container to manually remove the chemical and/or any other debris, such as, for example, scaling, that may be contained within the container. While this may be a relatively thorough way to remove the chemical from the container, it may be very dangerous, as it requires an individual to actually enter the container thereby exposing the individual to any chemicals that may be contained therein. Further, by opening the container, there may be a significant risk that some of the chemicals may escape into the environment.

Therefore, an improved system of cleaning pressurized containers is necessary. Particularly, a system is needed that overcomes the problems associated with typical cleaning systems. Further, a system is needed that cleanly and efficiently removes chemicals from a pressurized container and transports the waste product to a proper disposal system such as a flare or a reaction tank to incinerate or otherwise safely dispose of the chemicals.

SUMMARY OF THE INVENTION

The present invention relates to a system for cleaning a pressurized container having chemicals therein. More specifically, the present invention allows mobile containers such as, for example, rail tank cars, to be cleaned safely and efficiently without risking exposure of the chemicals to people or the environment. The invention entails injecting heated and pressurized nitrogen gas or ambient air into the container thereby purging the container of any chemical therein and forming a nitrogen/chemical mixture. The nitrogen/chemical mixture may then be sent to a flare for incineration or a reaction tank for neutralization of the chemical. Further, the heated nitrogen gas may aid in pulling the chemical out of the container and transporting the chemical to the flare for incineration. In addition, a vacuum pump may be utilized to further aid in the removal of the nitrogen/chemical mixture from the container.

To this end in an embodiment of the present invention, a system for cleaning pressurized containers containing chemicals is provided. The system comprises: a container having a quantity of chemicals therein wherein the container has a plurality of valves for attaching a plurality of pipes thereto; a nitrogen gas storage tank wherein the nitrogen gas storage tank is attachable to a first valve on the container; a heat exchange means wherein the first pipe is heated by the heating means; a tank containing a caustic material connected to the container via a pipe; and a vacuum pump disposed between the container and the tank.

Further, a system is provided wherein the plurality of valves regulates a flow of nitrogen gas from the nitrogen gas storage tank and the container. Still further, the container is a railcar. Alternatively, the container is disposed on a vehicle.

Moreover, the present invention provides a system that further comprises a heating means connected to the heat exchange means for feeding a fluid to the heat exchange means for heating nitrogen gas that flows through the heat exchange means. Moreover, the system comprises a nitrogen vaporizer attached to a second section of the first pipe for vaporizing the nitrogen from the nitrogen storage tank.

In addition, a pipe within the container is attached to a valve wherein the first pipe within the container extends to a bottom of the container. Additionally, a pipe within the container is attached to a valve and extends partially within the container.

In a further embodiment of the present invention, the system comprises a controller interconnected with the plurality of valves for controlling the opening and closing of the valves. Moreover, the controller controls the vacuum pump. Moreover, the controller controls the opening and closing of the plurality of valves in synchronization with the vacuum pump.

In addition, the system further comprises a gauge attached to the container for measuring the internal pressure of the container. In addition, the tank comprises a quantity of a material selected from the group consisting of sodium hydroxide, potassium hydroxide, sodium carbonate, calcium hydroxide, sodium sulfite, sodium thiosulfite, ferrous chloride and solid bed absorbents. Further, the tank neutralizes chlorine gas and sulfur dioxide gas. Still further, a first pipe extends from the container to the vacuum pump and a second pipe extends from the vacuum pump to the tank containing the caustic material.

In an alternate embodiment of the present invention, a system for cleaning pressurized containers containing chemicals is provided. The system comprises: a container having a quantity of chemicals therein wherein the container has a plurality of valves for attaching a plurality of pipes thereto; an intake means for blowing air into the container via a first pipe; a heating means wherein the first pipe is heated by the heating means; a tank containing a caustic material connected to the container via a pipe; and a vacuum pump disposed between the container and the tank having caustic material contained therein. Moreover, the intake means comprises a fan. In addition, the air is regulated into the container via a first valve wherein the first valve is connected to a controlling means. Moreover, a pressure gauge is attached to one of the plurality of valves for measuring the pressure within the tank. In addition, a control panel having a plurality of switches for controlling the system.

In a further embodiment of the present invention, the tank comprises a quantity of a material selected from the group consisting of sodium hydroxide, potassium hydroxide, sodium carbonate, calcium hydroxide, sodium sulfite, sodium thiosulfite, ferrous chloride and solid bed absorbents. Moreover, the tank neutralizes chlorine gas and sulfur dioxide gas. Further, a first pipe extends from the container to the vacuum pump and a second pipe extends from the vacuum pump to the tank containing the caustic material.

It is, therefore, an advantage of the present invention to provide a system for cleaning a pressurized container having a quantity of chemicals therein that safely and efficiently removes chemicals from the container. Moreover, it is advantageous that the present invention removes chemicals from the container without risking exposure to people or the environment.

Further, it is an advantage of the present invention to provide a system for cleaning a pressurized container having a quantity of chemicals therein that allows the chemicals to be removed without causing damage to the container by freezing the container or pipes connected thereto. In addition, an advantage of the present invention is that the heated nitrogen gas used to remove the product will not condense within the container and therefore will not mask the presence of the chemicals therein.

Another advantage of the present invention is to provide a system for cleaning a pressurized container having a quantity of chemicals therein that is largely automatic and therefore allows an individual to monitor the process without exposing the individual to the chemicals. Additionally, an advantage of the present invention is that a plurality of types of containers may be cleaned using the system and method defined herein, including, but not limited to, rail tank cars and other like containers.

A still further advantage of the present invention is to provide a system for cleaning a pressurized container having a quantity of chemicals therein that utilizes a vacuum pump to remove chemicals from the container and to create a vacuum in the container to aid in the injection of heated nitrogen gas to the container.

Additional features and advantages of the present invention are described in and will be apparent from, the detailed description of the presently preferred embodiments and from the drawings.

DETAILED DESCRIPTION OF THE PRESENTLY PREFERRED EMBODIMENTS

The present invention relates to a system for cleaning pressurized containers such as, for example, rail tank cars and the like. More specifically, the present invention provides a system for cleaning pressurized containers that includes, but is not limited to, injecting heated, pressurized nitrogen gas or dry ambient air into a container having a quantity of chemicals therein. The chemicals may be moisture sensitive. The nitrogen gas purges the container of the chemical or chemicals contained therein. The chemical or chemicals may then be transported to a reaction tank via a vacuum pump for reaction in a caustic solution or may otherwise be collected for disposal. The reaction tank may be configured as a reaction chamber for any number of chemicals as may be apparent to those skilled in the art, such as, for example, chlorine gas and/or sulfur dioxide gas. The present invention allows the containers to be cleaned quickly, safely and efficiently without exposing individuals to undue risk of exposure.

Figure 1:
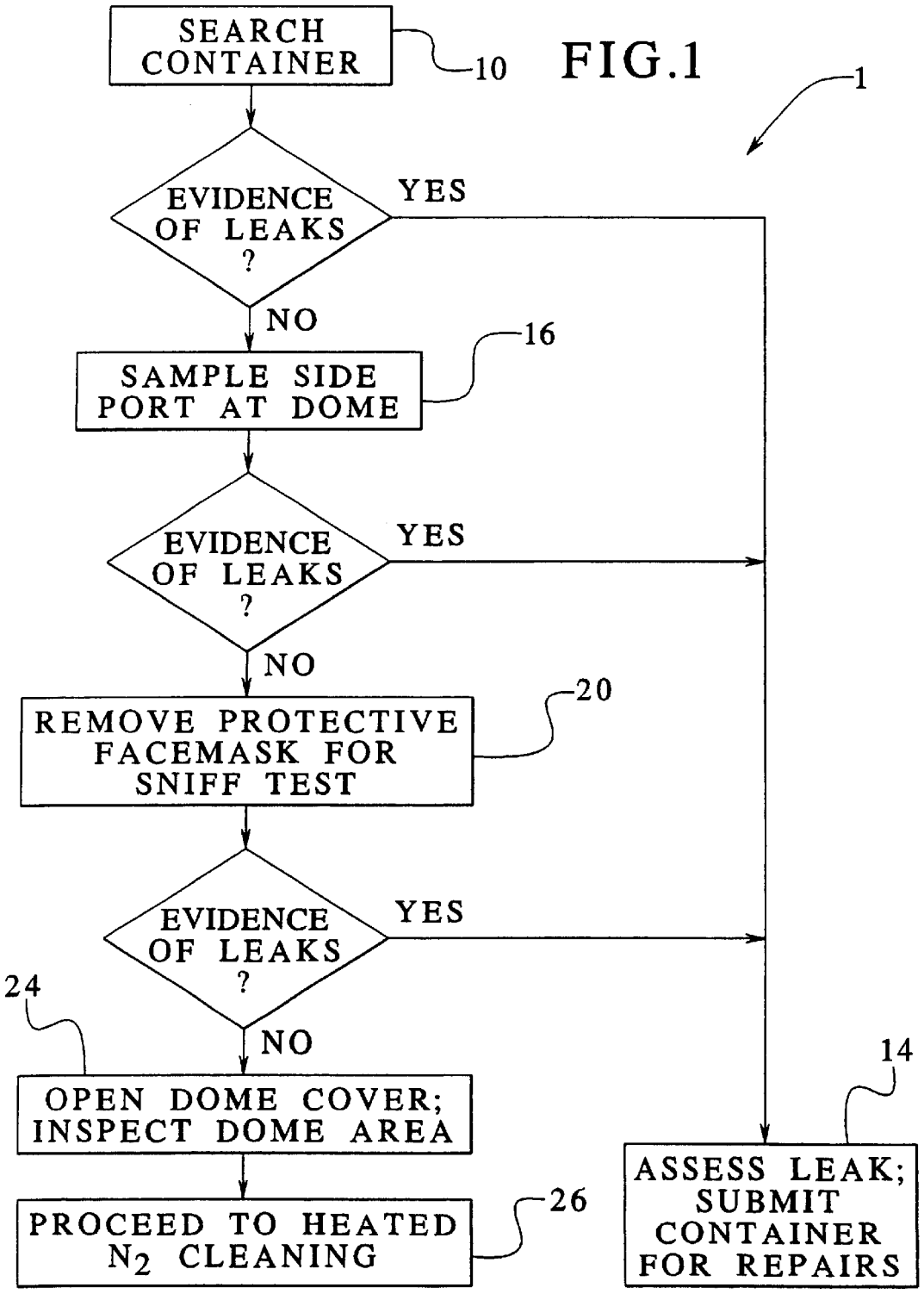
FIG. 1 illustrates an inspection process in an embodiment of the present invention for pressurized containers to be used prior to the cleaning of the containers by the heated nitrogen.
Figure 2:
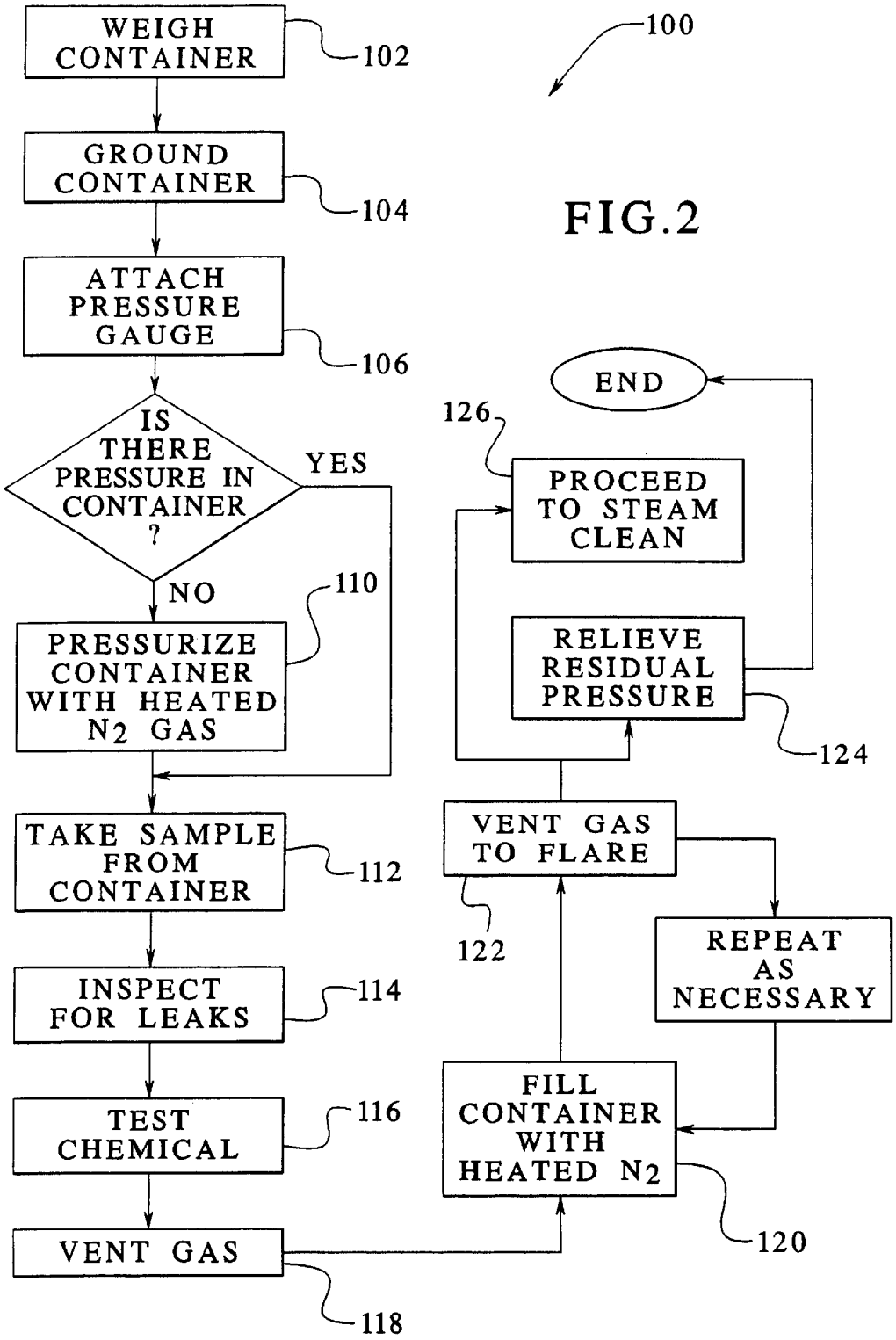
FIG. 2 illustrates a heated nitrogen gas cleaning process for the pressurized containers.
Figure 3:
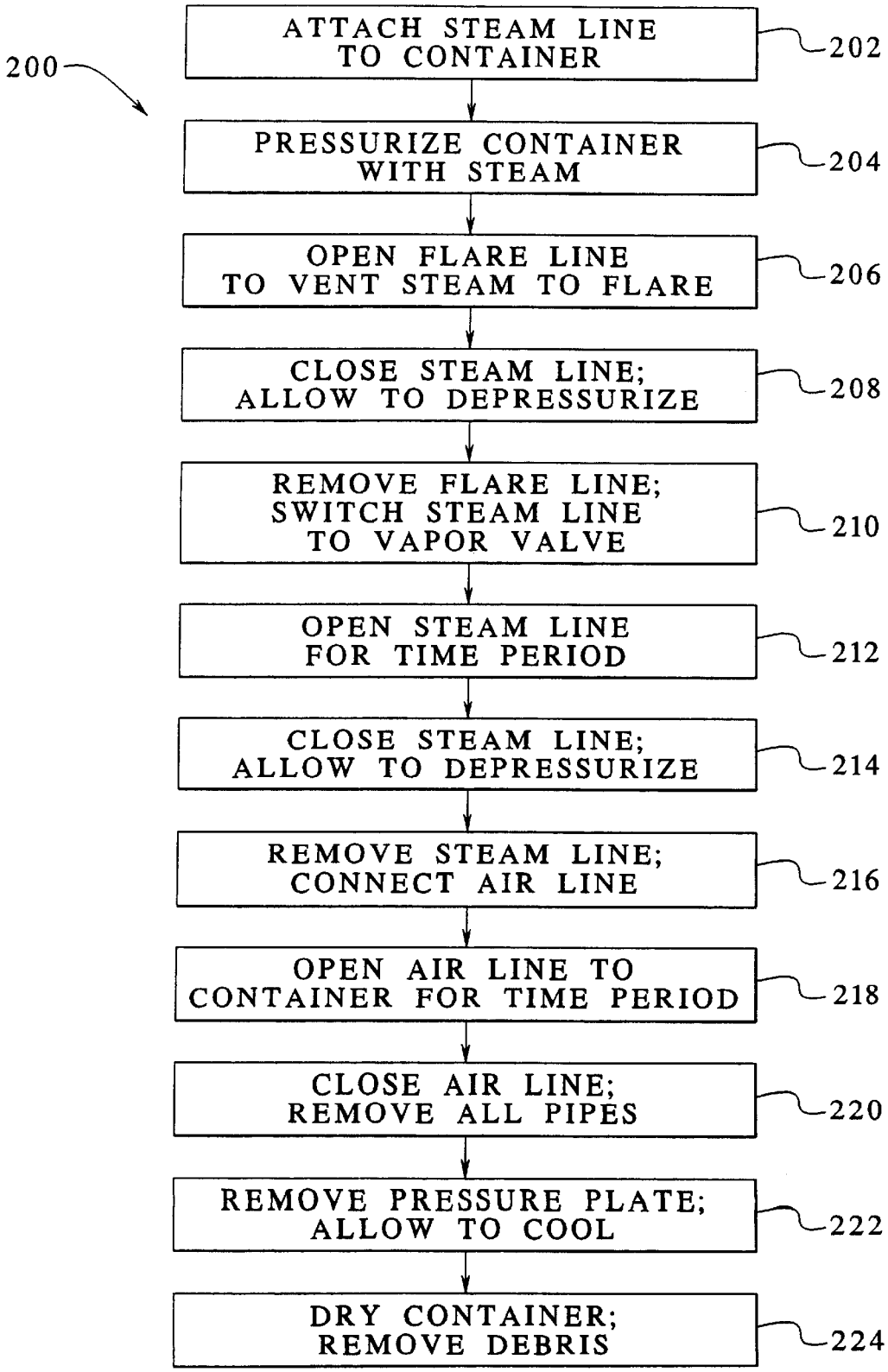
FIG. 3 illustrates a steam cleaning process for the pressurized containers to be conducted after the heated nitrogen process.
Figure 4A:
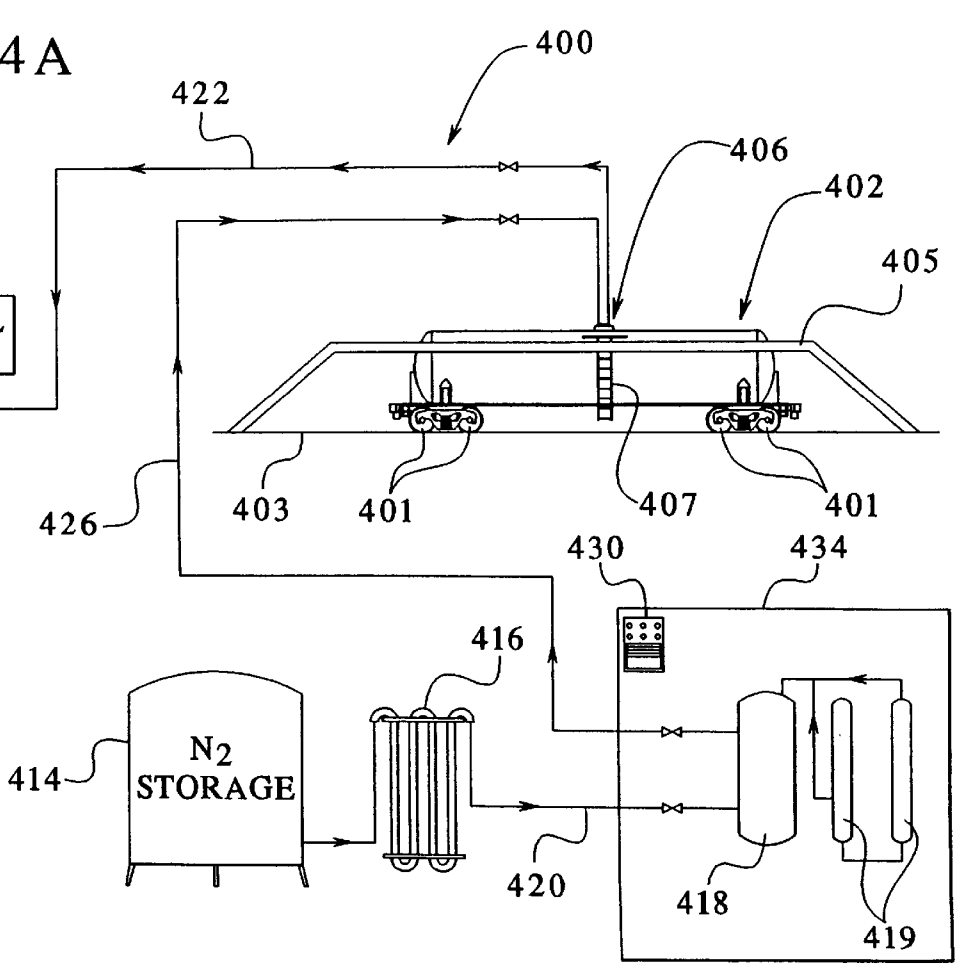
FIG. 4A illustrates a cleaning system for pressurized containers, such as, for example, for rail tank cars in an embodiment of the present invention. Further.
Figure 4B:
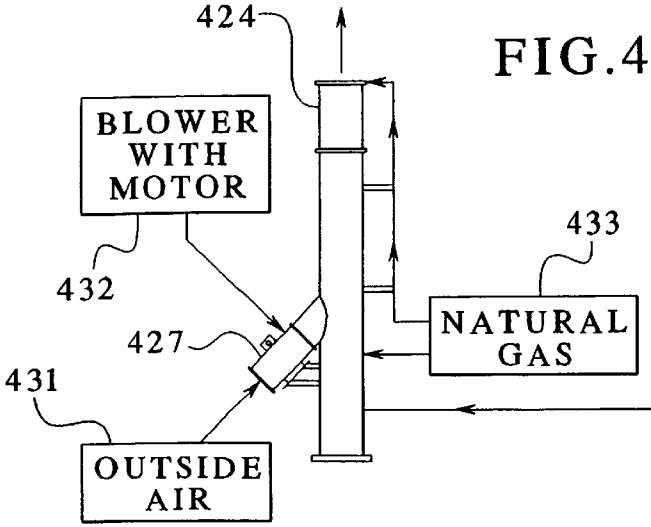
FIG. 4B illustrates a protective housing, headspace, valves and sideports situated atop a container.
Figure 4B:
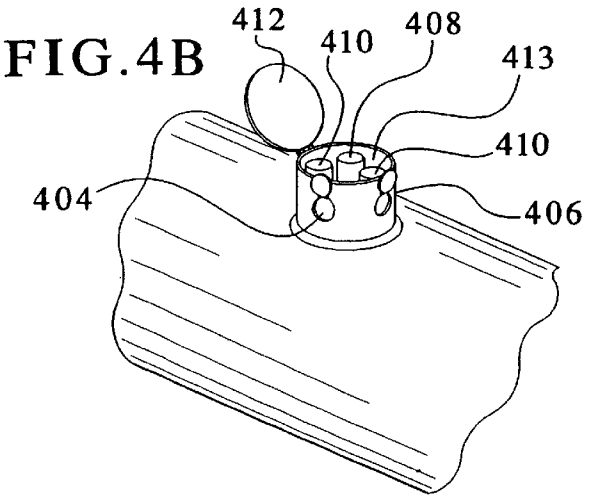

Referring now to the drawings, wherein like numerals refer to like features, FIGS. 1 to 3 show three embodiments of a cleaning method according to the present invention. Further, FIGS. 4A and 4B illustrate a cleaning system for a container, such as for a rail tank car, whereby the container may be cleaned. Although this system for cleaning containers may be utilized with any pressurized container apparent to those skilled in the art, mobile or immobile, the system herein described relates specifically to rail tank cars or other mobile container situated atop a plurality of rails.

A rail tank car may include, but may not be limited to, a pressurized container 402 on a plurality of rail wheels 401 (also called a truck) allowing the container 402 to be transported on a track 403 from one location to another. It should be noted that rail tank cars may include any mobile container apparent to one skilled in the art. Typical rail tank car containers may have a protective housing 406 atop the container 402. The protective housing 406 have a plurality of valves 408,410 (as shown in FIG. 4B) contained therein for attaching pipes or lines thereto. Valve 408 may be a vapor-type valve that may typically be utilized to remove vapors from the container 402. The valves 410 may be liquid-type valves that may allow a liquid chemical to be added or removed from the container. Typically, the liquid valves 410 may be connected to pipes that may go to the bottom of the container 402. Alternatively, the vapor valve 408 maybe connected to a pipe that merely goes to space near the top of the container 402. Although many rail tank cars may have only three valves within the protective housing 406, this invention should not be limited in that regard. Any number and type of valves may be contained within the protective housing 406. Moreover, the valves need not be located only within the protective housing. Valves may be located in any location on the container 402 to remove or add materials to the container 402.

A pressure plate (not shown) may be included within the protective housing 406 that may be openable to allow an individual to gain access to an interior of the container 402. The pressure plate may be disposed on the bottom of the protective housing 406 and may be fixed to the container 402 via bolts (not shown). When an individual wishes to gain access to the interior of the container 402, the pressure plate may be removed by removing the bolts. To remove the pressure plate, the protective housing 406 and valves 408, 410 should be removed from the container 402. However, the pressure plate may be disposed anywhere on the container 402 as may be apparent to those skilled in the art.

The protective housing 406 may be opened via a lid 412 to gain access to the valves 408,410 and headspace 413 that may be contained therein. Further, the protective housing 406 may have at least three sideports 404 for gaining access to the valves 408,410 within the protective housing 406 without opening the protective housing 406 by the lid 412.

The container 402 may contain any chemical or chemicals that may be apparent to those skilled in the art. Further, the chemicals may be of a hazardous nature that may pose a risk to individuals exposed to the chemical. Specifically, the chemical or chemicals may typically be in gaseous form when under standard temperature and pressure. However, the chemical or chemicals may be a liquid when stored under pressure within the container 402. Typical chemicals that may be stored within the container may include, but may not be limited to, liquefied petroleum gas ("LPG") and/or anhydrous ammonia ("AA"). LPG may include, but may not be limited to, the following chemicals: butane, isobutane, propane, propylene, butylenes and other chemicals apparent to those skilled in the art. Hawley's Condensed Chemical Dictionary 703 (12th ed. 1993). Moreover, LPG may include mixtures of these materials. LPG is typically extremely flammable when in gaseous form. Moreover, other chemicals that may be stored within the containers that may be cleaned using the system and methods described herein may be butadiene, butene, butyne, cyclobutane, cyclopropane, dimethyl propane, ethane, ethylene oxide, propyne, ethylene, methyl butene, methyl ether, methyl propene, 1,3-pentadiene and other chemicals apparent to those skilled in the art.

Referring now to FIG. 1, an inspection process 1 is shown that may be instituted prior to cleaning the container 402 via the cleaning process described herein with reference to FIGS. 2 and 3. The container 402 may be carefully preliminarily inspected via a "search container" step 10. Specifically, an inspector may move around the container 402 looking for evidence of leakage of the chemicals via step 12. Leaks may be apparent by wet spots, corrosion in a particular area, hissing or the like. Of course, the inspector should wear applicable safety clothing and equipment and approach the container from upwind to protect the inspector from the deleterious effects of any leaking chemical. Further, the inspector may use a catwalk 405 or other structure to allow the inspector to inspect all areas of the container 402 including the top of the container 402. Likewise, the inspector may use a ladder 407 to get relatively close to the protective housing 406 and the valves 408, 410 contained therein. This preliminary inspection may be done by visually searching for leaks around the container 402 and any valves or pipes protruding therefrom. If the inspector sees evidence of leakage, then the process 1 may be halted while the inspector or other individual assesses the leak via step 14. The container 402 may be submitted to a repair facility to repair the leak prior to continuing the process 1.

If, however, the inspector sees or otherwise has detected no indication or evidence of leakage from the container 402 via the "search container" step 10, the inspector may sample one or more of the sideports 404 via step 16 using a leak detection device. The sideport 404 may allow an individual to gain access to the valves within the protective housing 406 without opening the protective housing 406 and exposing the individual to a large amount of the chemicals that may be contained within the headspace 413.

For example, an apparatus may remove a sample of gas from one of the sideports 404 via step 16 to determine if there is a leak in a valve or seal within the protective housing 406. The apparatus may include any device capable of determining a chemical composition of a volume of air, such as, for example, a Draeger® detector or a multi-gas tester manufactured by Industrial Scientific Corporation ("ISC"). A Draeger® detector may measure the chemical composition in ppm. The multi-gas tester may detect an oxygen "lower explosion limit" ("LEL") of a volume of gas. The multi-gas tester may test for the LEL by creating a combustion of the gas in the sample and sensing the heat produced. The heat produced is directly related to the percent LEL of the sample.

If there is evidence of a leak at the sideport 404, an assessment may be made via step 14 concerning whether the container 402 may be cleaned or whether the container 402 should be submitted for repairs. However, if there is no evidence of leaks from the sideport 404, then the seal of the inspector's face mask may be broken so that the inspector may test for odors via step 20 at the sideport 404. If there is evidence of a leak then the leak may be assessed via step 14. For safety purposes, however, the inspector may not break the seal of his or her facemask to test for odors.

If there is no evidence of a leak or leaks during step 20, then the inspector's facemask may be completely removed and the protective housing lid 412, as shown in FIG. 4B, may be opened. The headspace 413 and the valves 408,410 may be inspected visually via step 24. The inspector may note the valve types and damage to the valves, pipes, and/or fittings contained within the protective housing 406. If there is substantial damage to any valve, pipe or fitting or to the container 402 itself, the damage may be assessed via step 14 and a decision may be made as to whether the cleaning process should be continued. If the container 402 passes the inspection, then a cleaning process 100 may begin, as shown in FIG. 2.

Referring now to FIG. 2, a cleaning process 100 is illustrated. The cleaning process 100 may be utilized to clean the container 402 having an amount of a chemical therein. Specifically, the cleaning process 100 may be used to clean containers having LPG or AA, however any chemical or mixture of chemicals may be contained within the container as may be apparent to those skilled in the art.

The container 402 may have a tare weight printed in an accessible location, such as, for example, on a side of the container for easy visual access. The container 402, having been inspected for leaks pursuant to the inspection process 1 as shown in FIG. 1, may be weighed via a "weigh container" step 102 and compared against the tare weight of the container 402 to determine a weight of the chemical contained therein. The amount of chemical is important to make projections concerning how the container 402 may be cleaned and how long the cleaning process may take to get the chemical out of the container 402. Alternatively, the "weigh container" step 102 may be skipped.

After the container 402 is weighed, it may be grounded via step 104 to minimize the possibility of a spark being generated that may ignite the hazardous chemical contained therein. Specifically, a ground wire may be connected to a ground lug on the container 402 or in any other locations apparent to a person having ordinary skill in the art.

After the container 402 is grounded, a pipe and a pressure gauge (not shown) may be attached to the vapor valve 408 via step 106. The vapor valve 408 may then be opened slowly to pressurize the gauge allowing an individual to note and record the pressure contained within the container 402. It should be noted that the valves 408,410 on the container 402 and pipes attached to the container 402 may be any size and/or shape that may be apparent to those skilled in the art. The pressure gauge may indicate whether there is residual pressure of the chemicals within the container 402. If there is residual pressure within the container 402, then a sample may be removed from the container 402 via step 112. However, if there is no residual pressure within the container 402, then the container may be filled with nitrogen gas through one of the liquid valves 410 and the container 402 may be filled to a known pressure via step 110 so that a sample of the nitrogen/chemical mixture may be taken from the container 402 via step 112. The pressure after addition of the nitrogen gas via step 110 may be above about 0 psi and below about 12 psi after nitrogen is added thereto. However, about 6 psi is preferable for removing a sample therefrom.

The nitrogen that may be used to fill the container 402 in step 110 or that may be added to clean the container 402 may be heated before entering the container 402. Heating the nitrogen serves the purpose of providing a large volume of nitrogen gas to aid in cleaning the container 402. Further, heating the nitrogen ensures that no liquid nitrogen enters into the container 402 to damage parts of the container 402. For example, liquid nitrogen may freeze important parts such as valves and pipes and further may cause the walls of the container to freeze and crack. As shown in FIG. 4A, the nitrogen may be stored in a tank 414 and allowed to flow through a nitrogen vaporizer 416. Generally, the nitrogen vaporizer uses ambient temperatures to convert the liquid nitrogen into the gas phase. However, ambient temperatures may be relatively low depending upon where the system is located. Therefore, the nitrogen may then be vaporized by the addition of heat. The nitrogen may flow to a steamer 418 via a pipe 420 where the pipe 420 may be heated by steam to a desired temperature. The steam itself may be heated by boilers 419. Typically, the nitrogen gas may be between 100° F. and 300° F. but may preferably be 200° F. The nitrogen, however, should be at least 100° F. or above to ensure that no liquid nitrogen flows into the container 402. The temperature of the nitrogen gas may be verified using a thermometer prior to entering the container 402. The heated nitrogen gas may then be added to the container 402 via an input line 426.

After the heated nitrogen gas is added to the container 402 to a pressure of about 6 psi via step 110 or if there already is residual pressure within the container 402, a sample of the chemical may be removed from the container 402. The pressure within the container 402, either residual or added via step 110, may allow the sample to be withdrawn from the container 402. The sample may be withdrawn from any valve or pipe.

The container 402 may again be inspected for leaks via step 114. If a leak is detected around the protective housing area and the reading is about 10% or more of the LEL for liquefied petroleum gas or over about 50 ppm for anhydrous ammonia, then the leak must be assessed to determine whether the container should be removed from the cleaning process. If no leak is detected, then the vapor valve 408 may be closed and the pressure gauge may be removed.

The sample taken from the container 402 may be sampled, tested and verified via step 116. Specifically, a "commodity sampling device" ("CSD") may preferably be connected to the pipe leading from the vapor valve 408. However, the sample may be taken as noted with respect to step 112, from any pipe or valve having direct access to the interior of the container 402. The vapor valve 408 may then be opened to allow vapors within the container 402 to flow to the CSD. An amount of vapor, preferably enough to fill the sampling device to half full, may then be removed from the container 402. The CSD may be a Draeger® apparatus or any other sampling device and may be utilized to verify the identity of the contents of the container 402. This verification may ensure that the chemical or chemicals contained therein are properly identified and, therefore, handled safely and properly during the cleaning of the container 402. If the pressure of the chemical is over a predefined level, such as preferably 100 psi, or if the weight of the chemical within the container is above a predefined level, such as preferably 2000 pounds, then the container 402 may be removed from the cleaning process.

After the chemical material's identity has been verified via step 116, the vapor valve 408 may be attached to a flare line 422. For example, the flare line 422 may be attached to a hammerlock fitting that is on a 2" attached to the vapor valve 408. However, the flare line 422 may be attached to the vapor valve 408 in any way apparent to one having ordinary skill in the art. The flare line 422 may run from the container 402 to a flare 424, as shown in FIG. 4A. The flare 424 may ignite to form a flame using ignited natural gas 433 as a pilot. Highly combustible chemicals, such as LPG, may be fed directly into the flare 424 and incinerated using the flame of the pilot to ignite the chemicals. However, a flare ring may be ignited using the natural gas 433 to fully combust less combustible materials, such as AA. As shown in FIG. 4A, the flare line 422 may allow the chemical to be fed into the flare 424 causing the hazardous chemical to be incinerated as it passes through the flare. Further, outside air 431 may be fed into the flare 424 using a blower with a motor 432 to aid in the burning of the hazardous chemical within the flare 424. Typically, the blower with the motor 432 may be utilized to aid in the burning of less combustible materials, such as, for example, AA or higher combustible materials at low concentrations. To ensure complete burning of the chemicals within the flare 424 the blower with the motor 432 and the flare ring may be used together. Further, the blower may be used with highly combustible materials such as LPG for smokeless operation of the flare 424. The flare 424 may be engineered to burn a plurality of different chemicals, such as, preferably, liquefied petroleum gas and anhydrous ammonia. For example, a flare engineered and provided by Tornado Technologies Inc. may be used in this invention for the burning of chemicals such as LPG and AA.

The vapor valve 408 may then be opened to allow the gas contained therein to vent to the flare 424 thereby incinerating the residual gas contained within the container 402 via step 118. During this process, the container may again be inspected for leaks. If the chemical detection meter shows a level of the chemical at a given level, such as preferably about 75% of the LEL for liquefied petroleum gas or about 50 ppm for anhydrous ammonia, then the leak should be assessed. Based on the severity of the leak, the container may be taken from the cleaning process for repairs. As the pressure is relieved and the gas is released, the chemical therein may be vented to the flare 424. When the pressure within the container 402 reaches a predetermined level, such as between about 0 psi and about 6 psi and preferably about 3 psi, then the vapor valve 408 may be closed. An indicator light (not shown) may show when the pressure within the container 402 reaches the predetermined level.

At this point, the heated nitrogen line 426 may be attached to one of the liquid valves 410 while the flare line 422 remains connected with the vapor valve 408. A pressure gauge may be attached to the other liquid valve 410. The heated nitrogen may then be added to the container 402 via step 120 to raise the pressure within the container 402 to a desired value. The desired value may be between about 10 psi and about 30 psi and preferably about 18 psi although any pressure is contemplated that may be apparent to those skilled in the art. The vapor valve 408 may then be opened releasing the gas to the flare 424 via step 122 thereby incinerating the chemicals that may be contained therein. When the pressure reaches a desired value between about 0 psi and about 6 psi, preferably about 3 psi, the vapor valve may be closed.

The addition of heated nitrogen to the container 402 via step 120 and the subsequent venting to the flare 424 via step 122 may be repeated as desired so that the concentration of the chemical within the container 402 may reach a desired level. If the container 402 is not to be steam cleaned and is to be used to store and/or carry the same type of chemical that it had previously stored and/or carried and the concentration of the chemical therein has reached the desired level, then the residual pressure within the container 402 may be vented to the flare 424 via step 124 and the container 402 may be detached from all pipes and/or lines. It should be noted if the container 402 is not to be steam cleaned, a preferable concentration level of chemical within the container may be about 50% of the LEL for the liquefied petroleum gas or about 10,000 ppm for anhydrous ammonia. Typically, it may take a plurality of cycles of nitrogen gas to clean the container 402 to the desired level. For example, it may take six or more cycles to reach the desired level. However, any number of cycles may be performed as may be apparent to those skilled in the art. The container 402 may then be removed from the cleaning area and may be repaired or transported away.

However, if the container 402 is to transport and/or store a different chemical than previously contained therein then the container 402 should be steam cleaned via the steam cleaning process 200 shown in FIG. 3. Further, if the pressure plate (not shown) on the container 402 is to be removed (for example, to thoroughly clean therein with steam, as shown in FIG. 3), then the container 402 may be cleaned using heated nitrogen gas twice before the pressure plate is removed and the container 402 is steam cleaned.

Prior to steam cleaning via a process 200 shown in FIG. 3, the container 402 may first be prepared for the steam cleaning. For example, a rail tank car may have a magnetic gauging device rod that may be removed or it may get damaged during the steam cleaning. In addition, other devices may be removed from the container 402 in preparation for the steam cleaning process 200.

After the container 402 is prepared for the steam cleaning, a steam line (not shown) may be attached to the liquid valve 410 via step 202 for adding steam to the container 402. The liquid valve 410 may then be opened to pressurize the container 402 with steam to a desired pressure via step 204. An adequate range of pressure may be between about 10 and about 20 psi, preferably about 15 psi. Alternatively, the container 402 may be pressurized for a period of time, preferably about three minutes. The vapor valve 408 having the flare line 422 attached thereto may be opened to vent the steam to the flare 424 via step 206. Residual chemicals that may still be contained within the container 402 may thereby be removed. The steam may be vented through the container 402 for a desired period of time, preferably about 30 minutes, to thoroughly clean the interior of the container 402. After the desired period of time, the liquid valve 410 may be closed allowing the container 402 to depressurize via step 208. The flare line 422 may be removed via step 210 and the steam line may be moved from the liquid valve 410 to the vapor valve 408.

Pipes may be attached to the liquid valve 410 and may allow the steam flowing therethrough to be vented directly to the atmosphere. After the liquid valve 410 and vapor valve 408 have been opened, the container 402 may be steamed via step 212 for a desired period of time, preferably about 3 or 3½ hours. The waste steam may be vented through a pipe attached to the liquid valve 410.

After the container 402 has been steamed for the desired period of time via step 212, then the vapor valve 408 may be closed, and the steam therein allowed to vent to the atmosphere thereby depressurizing the container 402 via step 214. The steam line (not shown) may be removed and an air line (not shown) may be attached to the vapor valve 408 via step 216. The vapor valve 408 may be opened and dry, cool air may be allowed to flow through the container 402 for a desired time period, preferably 30 minutes, via step 218 to allow the container 402 to become dry and cool.

After the desired time period is over, the vapor valve may be closed and all lines may be removed via step 220. The pressure plate (not shown) on the container 402 may be removed and the container 402 further allowed to cool via step 222. Finally, after the container 402 is cooled, the container 402 may be allowed to dry. Debris, such as residual scale and other deposits, may be removed via step 224 by fitting an individual within the container 402 with equipment to remove the debris.

The addition of heated nitrogen and steam and the subsequent venting of gases via the processes 1, 100 and/or 200 may be controlled by a control panel 430 having buttons, switches, lights, warnings, or any other controls or displays that may inform a user and allow a user to control the processes 1, 100 and/or 200 described above.

FIGS. 5A, 5B, 6 and 7 show an alternate embodiment of the present invention. More specifically, FIGS. 5A–7 show an embodiment of the present invention that may be utilized for cleaning pressurized containers that may contain gases, liquids or other materials that may be sensitive to water, such as, for example, chlorine gas, sulfur dioxide gas, or any other moisture sensitive material apparent to one having ordinary skill in the art. Specifically, chlorine gas and sulfur dioxide gas may form acids that may damage the container and/or other equipment and may otherwise be unsafe for individuals or the environment.

The present invention is particularly suitable for cleaning containers that may contain moisture sensitive materials such as, for example, chlorine gas and/or sulfur dioxide gas, because the present invention utilizes nitrogen gas, or any other dry and non-reactive gas such as dry ambient air, as shown below, to clean the material out of the container. Therefore, contact with moisture is minimized. Nitrogen gas is mostly non-reactive with most chemical substances. For example, if chlorine gas is exposed to water, a chemical reaction occurs producing hydrochloric acid. Similarly, if sulfur dioxide gas is exposed to water, sulfuric acid may be produced. These acids may cause damage to pipes, valves, the pressurized container, or any other equipment that the acids may contact. Moreover, the acids may pose a risk to people if leaks occur. The acids may further propagate leaks due to their reactive natures.

Figure 5A:
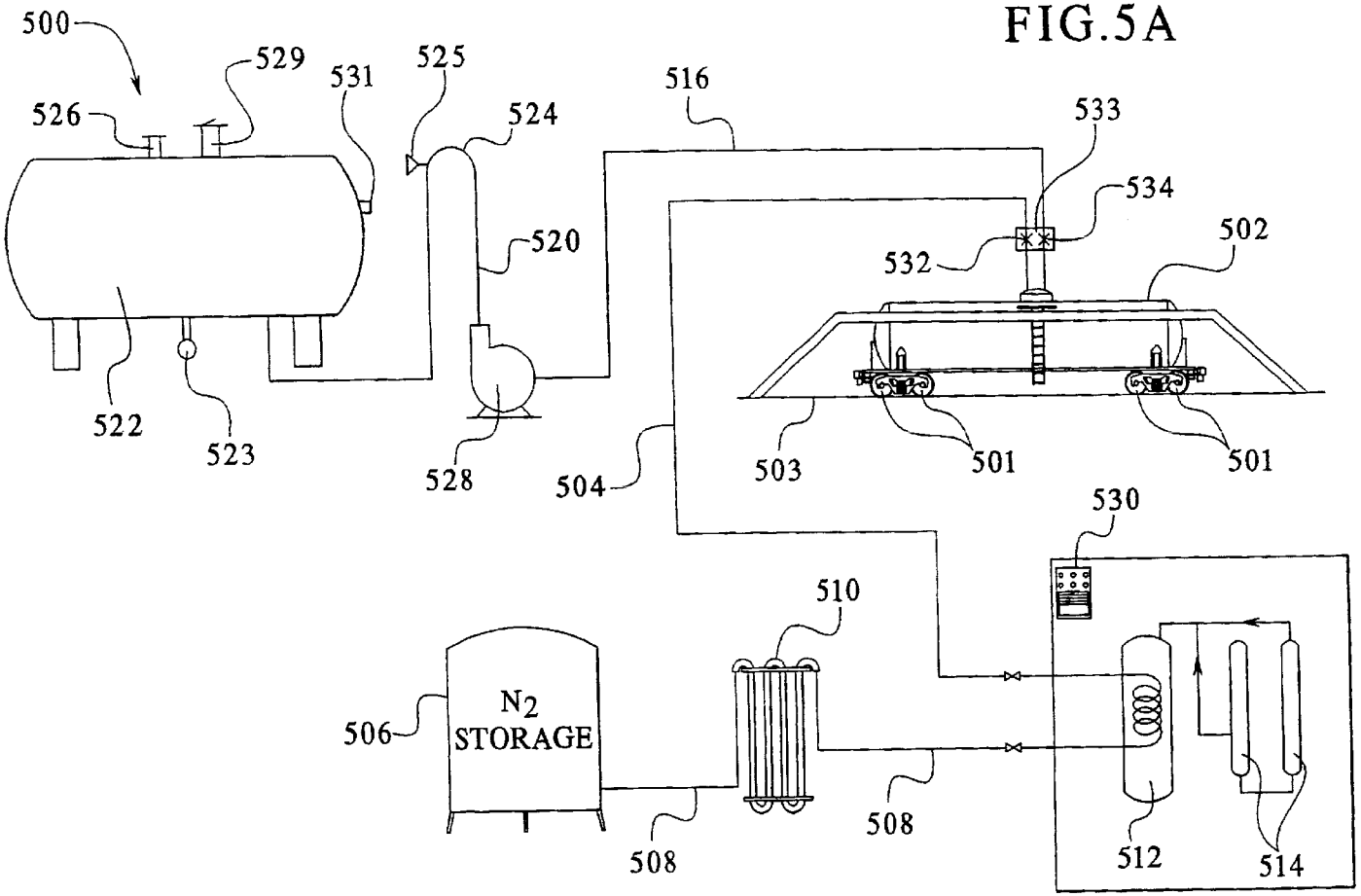
FIG. 5A illustrates a cleaning system for pressurized containers, such as, for example, for rail tank cars having a quantity of moisture sensitive chemicals contained therein having a liquid nitrogen tank for feeding nitrogen gas into the cleaning system. Further.

FIG. 5A shows an embodiment of the present invention of a system 500 for a pressurized container that may be used to store and/or transport moisture sensitive materials. As noted above, the moisture sensitive materials may be materials that may form acids or other hazardous compounds upon exposure to water. For example, chlorine gas and sulfur dioxide gas may form hydrochloric acid or hydrochlorous acid and sulfuric acid, respectively, upon reacting with water. Moreover, the pressurized container may be a rail tank car 502 that may have a plurality of wheels on trucks 501 that may be moveable on a track 503.

As noted above with respect to FIG. 4B, typical rail tank cars may have a protective housing 406 atop the rail tank car 502. The protective housing 406 may have a plurality of valves 408,410 contained therein for attaching pipes or lines thereto. Valve 408 may be a vapor valve that may typically be utilized to remove vapors from the rail tank car 502. The valves 410 may be liquid valves that may typically allow a liquid chemical to be added or removed from the rail tank car 502. Typically, the liquid valves 410 may be connected to pipes that may go to or relatively near the bottom of the rail tank car 502. Alternatively, the vapor valve 408 may be connected to a pipe that merely goes to head space near the top of the rail tank car 502. Although many rail tank cars may have only three valves within the protective housing 406, this invention should not be limited in that regard. Any number and type of valves may be contained within the protective housing 406. Moreover, the valves need not be located only within the protective housing. Valves may be located in any location on the container 402 to remove or add materials to the container 402.

An input pipe 504 may be connected to one of the liquid valves 410 that may be attached to the rail tank car 502 and may function as an input pipe for the addition of nitrogen gas to the rail tank car 502. Although the pipe 504 may be attached to the liquid valve 410 in a preferred embodiment of the present invention, any valve may be utilized that may be apparent to one having ordinary skill in the art. Moreover, the pipe 504 may be connected to the rail tank car 502 in any manner that allows nitrogen gas to enter the rail tank car 502. Further, the input pipe 504 may comprise a plurality of pipes that attach to a plurality of input valves, or any other valves apparent to one having ordinary skill in the art.

The nitrogen gas that may be added to the rail tank car 502 may be stored within a liquid nitrogen storage tank 506 that may be released via a pipe 508 that may then allow liquid nitrogen to flow through a vaporizer 510 that may convert the liquid nitrogen to nitrogen gas via the ambient air temperature. The nitrogen gas may then flow through a heater 512 that may heat the nitrogen gas up to a temperature that ensures that the nitrogen is fully in gaseous form. The heater 512 may be comprised of pipes having steam, hot water, or any other material that may be used to heat the nitrogen. The material within the heater 508 may include boilers 514 that may heat the material to a sufficient temperature. Preferably, the nitrogen may be between about 100° F. and about 300° F. when it enters the rail tank car 502. Most preferably, the nitrogen may be about 200° F. However, the nitrogen should be above about 100° F. to ensure that no liquid nitrogen enters the rail tank car 502 via the input pipe 504. However, it should be noted that the system 500 may utilize unheated nitrogen gas, although heated nitrogen gas is preferred.

An output pipe 516 may be connected via another of the valves that may be disposed on the rail tank car 502. Preferably, the output pipe 516 may be connected to the vapor valve 408, although the output pipe 516 may be connected to any valve or other apparatus on the rail tank car 502 that may be apparent to one having ordinary skill in the art. Moreover, the output pipe 516 may comprise a plurality of pipes that may be connected to a plurality of output valves, vapor valves, or any other type of valves that may be apparent to one having ordinary skill in the art. The output pipe 516 may further be connected, on an end opposite the rail tank car 502, to a vacuum pump 518 or other apparatus that may draw material out of the rail tank car 502. An extension 520 of the output pipe 516 may be disposed connecting the vacuum pump 518 to a reaction tank 522 that may have a "back-flow preventer" loop 524 to prevent material from flowing back through the output pipe 516 from the reaction tank 522. Further, a restrictor valve 525 may be used to restrict the movement of any liquid that may attempt to back-flow along the backflow preventer loop 524.

As noted above, the reaction tank may have the section 520 of the output pipe 516 attached thereto for feeding materials into the reaction tank 522 from the rail tank car 502. The reaction tank 522 may have a quantity of a neutralizing chemical that may react with the material entering the reaction tank from the rail tank car. Typical chemicals that may be utilized to neutralize moisture sensitive chemicals (i.e. chemicals that may react with water to form acids such as, for example, chlorine gas and sulfur dioxide gas) may be sodium hydroxide, potassium hydroxide, sodium carbonate, calcium hydroxide, sodium sulfite, sodium thiosulfite, ferrous chloride, solid bed absorbents, and/or any other material that may be apparent to one having ordinary skill in the art to neutralize acids. Preferably, the reaction tank contains a quantity of sodium hydroxide. The invention will herein be described as containing sodium hydroxide, although any chemical may be utilized, as noted above, for neutralizing moisture sensitive chemicals as may be apparent to one having ordinary skill in the art, and the invention should not be limited as herein described. Further, the reaction described below is shown with respect to chlorine gas. However, the present invention should not be limited only to chlorine gas but should be construed as relating to any chemical that may form acids upon exposure to water, such as, for example, sulfur dioxide gas.

The main reaction between chlorine gas and sodium hydroxide may proceed as described below:

$$2\ NaOH+Cl_2 \rightarrow NaOCl+NaCl+H_2O$$

$$2\ NaOCl \rightarrow 2NaCl+O_2$$

$$3\ NaOCl \rightarrow 3NaClO_3+2NaCl$$

The salts formed, as described above, may stay in solution until they reach their solubility concentrations, at which point they will fall out of solution to form a solid. The solution within the reaction tank 522 may be monitored to ensure that the concentration of salts does not reach their solubility concentrations thereby minimizing the formation of solids that may plug the system. Certain reaction products of the reactions specified herein may be collected and/or recycled.

Additional reactions may occur within the reaction tank 522 that may be violently exothermic if precautions are not present to ensure that the reactions do not take place. For example, if the reaction tank 522 is over-chlorinated (i.e. if there is not enough sodium hydroxide to handle the chlorine gas that is entering the system), then the following reaction may occur:

$$NaOCl+Cl_2+H_2O \rightarrow 2HOCl+NaCl$$

Chlorate formation may then occur via the following reaction:

$$2HOCl+NaOCl \rightarrow NaClO_3+2HCl$$

The HCl formed above may combine with the hypochlorite ion to form more HOCl, so the excess chlorine may have a catalytic effect on chlorate formation. This is an exothermic reaction that may become violent if not prevented by ensuring that there is a sufficient concentration of sodium hydroxide within the reaction tank 522.

The reaction tank 522 may contain a safety vent 526 that may be utilized to relieve pressure build-ups within the reaction tank 522 if gases form to dangerous levels. Moreover, the reaction tank 522 may further comprise an analyzer or a plurality of analyzers (not shown) situated atop the reaction tank 522 inside a main vent 529 that may analyze the nitrogen gas that may exit the reaction tank 522 for the presence of the chemical that is being cleaned from the rail tank car 502. The main vent 528 may further comprise an entry for a person to physically enter the tank 522 if necessary. If working properly, the reaction tank may neutralize the chemical from the rail tank car 502 to a specific level.

The reaction tank 522 may further comprise a drain/fill valve 523 for adding or removing the reactive solution to or from, respectively, the reaction tank 522. The drain/fill valve may be utilized to alternately empty and/or fill the reaction tank 522. In addition, the reaction tank 522 may contain a sideport 531 that may be utilized to withdraw a sample from the reaction tank 522. The sideport 531 may be utilized to withdraw a sample from the reaction tank 522. Typically, the sample withdrawn from the reaction tank 522 may be used to monitor the amount of activity within the reaction tank 522. For example, if the concentration of a particular component within the reaction tank 522 reaches a particular level, indicating that the concentration of the component is either too low or too high, then the system 500 may be shut down and the concentration of the component may be adjusted.

The pipes of the system 500, as described above, may be formed of any material that may be apparent to those skilled in the art including, but not limited to, steel, lined pipe, PVC pipe, or any other material that may be utilized to transport heated nitrogen gas and moisture sensitive materials therethrough. Preferably, the pipes within the system 500 are composed of carbon steel and may be coated with a material that may be protect the pipes from damaging chemicals. Moreover, the pipes may be made of fiberglass, or any other material that may be apparent to one having ordinary skill in the art. Moreover, the valves may also be coated with a material to protect the interior of the valves. Preferably, the valves may be lined with Teflon® although any other coating may be utilized as apparent to one having ordinary skill in the art.

A control panel 530 may be utilized to control various aspects of the present invention. The control panel 530 may allow an individual to control the temperature, quantity and rate of heated nitrogen gas as it enters the rail tank car 502. Moreover, the control panel may allow an individual to control the heater 512 thereby regulating the temperature of the nitrogen gas before it enters the railcar 502. Specifically, the control panel may control a plurality of valves that may be located at various positions on the pipes within the system 500. For example an input valve 532 may be located at or near the liquid valve on the rail tank car 502, or on or near any other valve that the input pipe 504 may be connected to on the rail tank car 502 for allowing nitrogen gas to be input into the rail tank car 502. Moreover an output valve 534 may be disposed on or around the vapor valve, or on or near any other valve that may be utilized to connect the rail tank car 502 to the output pipe 516. The input valve a532 and the output valve 534 may allow an individual to regulate the input of nitrogen gas into the rail tank car 502 and the output of nitrogen gas and material from the rail tank car 502. Moreover, the control panel 530 may be utilized to regulate the input of nitrogen gas into the rail tank car 502 and the output of nitrogen gas and material from the rail tank car 502 from a safe distance. However, the liquid valve 408 and the vapor valve 408 may be utilized for this purpose as well.

In addition, the input valve 532 and the output valve 534 may be interconnected by a line 533 to bypass the tank car 502. This may allow an input of gas, such as, for example, dry air, nitrogen gas, or any other gas, to be input into the pipes of the system 500 without actually flowing through the rail tank car 502. The gas may be utilized to test each of the valves of the system to determine whether there are any leaks in the system. For example, a quantity of air may be pumped into the pipes of the system 500 and the system 500 may then be closed so that none of the air escapes from the system 500. If air does escape from the system 500 (if the pressure of the system 500 drops after the gas is pumped thereinto), then a leak may be present. Alternatively, the input valve 532 and the output valve 534 may be utilized to purge the system with nitrogen gas so that there is no moisture within the system 500 that may react with the moisture sensitive chemicals that may be contained within the reaction tank 522.

Further, the control panel may allow an individual to control the vacuum pump 518 and may allow an individual to turn the vacuum pump 518 on or off in synchronization with the operation of the input valve 532 and the output valve 534. For example, in a referred embodiment of the present invention, the vacuum pump 518, controlled by the control panel 530, may be activated at the same time that the output valve 534 is opened and the input valve 532 is closed. This may allow the vacuum pump to evacuate the gaseous contents of the rail tank car 502 while assuring that no material is allowed to enter the rail tank car 502 thereby creating a vacuum within the rail tank car 502. Moreover, the control panel 530 may further be utilized to shut the vacuum pump 518 off at the same time that the output valve 534 closes and the input valve 532 is opened allowing nitrogen gas to flow into the rail tank car 502. For example, the vacuum pump 518 may be utilized to evacuate the rail tank car 502 to a predetermined level. A preferable level of vacuum within the rail tank car 502 may be about −25 mm Hg. However, the vacuum may be any level apparent to one having ordinary skill in the art. Moreover, the vacuum pump 518 may have a tolerance level of about 10 psi, or any other pressure as may be apparent to one having ordinary skill in the art. If the pressure of the gas enters the system above about 10 psi, then the vacuum pump 518 may manually or automatically shut down. A limit switch (not shown) may be utilized to ensure that the gas that may have a pressure above about 10 psi does not enter the vacuum pump or the reaction tank 522 thereby causing damage to the vacuum pump 518 or the reaction tank 522.

It should be noted that the vacuum pump may be turned off at any time during a cleaning procedure to ensure safety of people and equipment. For example, if the vacuum pump gets clogged, then the vacuum pump may either be shut down manually, upon receiving a alarm, or the vacuum may be shut down automatically. The nitrogen gas may then act as to push the chemical from the rail tank car 504 to the reaction tank 522. In other words, it should be noted that the cleaning process as herein described may be done without the use of the vacuum. The pressure of the nitrogen gas may be sufficient to clean the rail tank car 502. Moreover, bypass valves and piping may be utilized to route the chemical/nitrogen gas mixture around the vacuum pump 518 if the vacuum pump 518 must be removed for repair.

The control panel 530 may further be utilized to monitor various aspects of the system 500, as may be apparent to one having ordinary skill in the art. For example, as noted above, the control panel 530 may be utilized to monitor and regulate the heater 512, thereby regulating the temperature of the nitrogen gas that may be allowed to enter the rail tank car 502. Moreover, the control panel 530 may monitor the analyzer within the main vent 528 that may be attached to the reaction tank 522. For example, if the concentration of the chemical that is being cleaned within the reaction tank 522 that may flow through the main vent 528 is higher than a predetermined level, as noted below, then the control panel may be used to shut down the system 500 so that the sodium hydroxide, or other neutralizing chemical within the reaction tank, may be changed or otherwise fixed so that the reaction tank may remove the chemical to the predetermined level as desired.

Of course, each component of the system 500 may be controlled manually without the use of the controller 530. Moreover, the control panel 530 may be interconnected with a computer or other processing unit to automatically control the components of the system 500. The computer or processing unit may be programmed to automatically turn the vacuum pump 518 on or off, regulate the input valve 532 and the output valve 534, or any other valve within the system 500, monitor the temperature of the nitrogen gas, and monitor the analyzer within the main vent 528, and/or any other component of the system 500 that may be apparent to one having ordinary skill in the art.

Figure 5B:
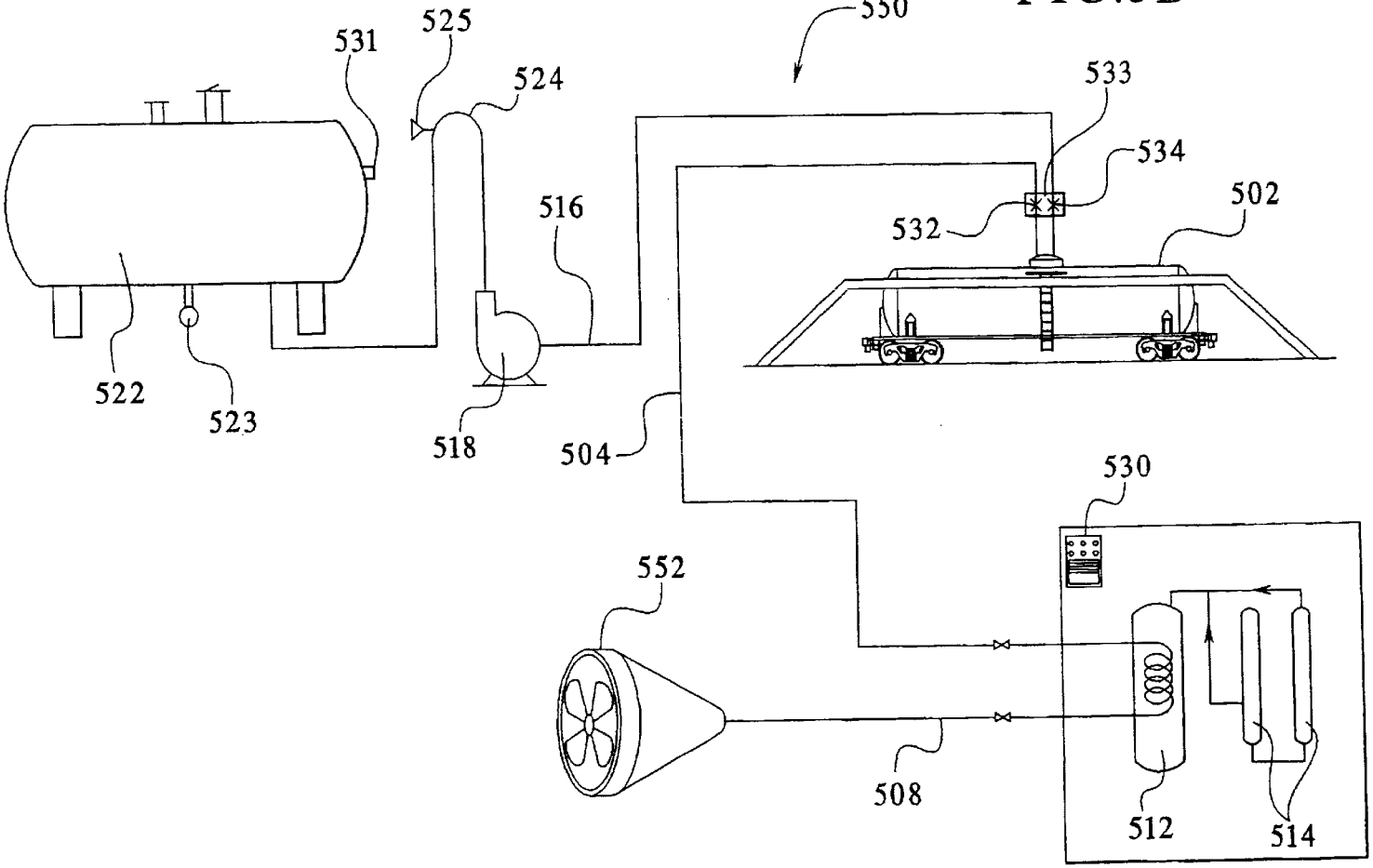
FIG. 5B illustrates a cleaning system for pressurized containers, such as, for example, for rail tank cars having a quantity of moisture sensitive chemicals contained therein and further having an air input fan to feed dry air into the cleaning system.

FIG. 5B illustrates an alternate embodiment of the present invention of a system 550 having an air input 552 that may take ambient air, which, of course, is comprised of about 70% nitrogen gas and smaller amounts of oxygen, carbon dioxide and other gases, and may feed the air into the heater 512 and, subsequently, into the rail tank car 502, in the same manner as described above with reference to the nitrogen gas as described in relation to FIG. 5A. The air input 552 may be a fan or other air intake mechanism that may pull air into the system 550. The air input 552 may be used in place of the nitrogen gas in regions where the ambient air has a low water content, such as for example, in dry, arid regions, since moisture may react with the chemicals within the rail tank car 502 and may cause the formation of acids or other damaging chemicals within the pipes or the rail tank car 502 of the system 550. Still further, an air dryer or a dehumidifier (not shown) may be incorporated into the system 550 of FIG. 5B to remove any moisture from the air that may be fed into the system 550 via the air input 552.

Figure 6:
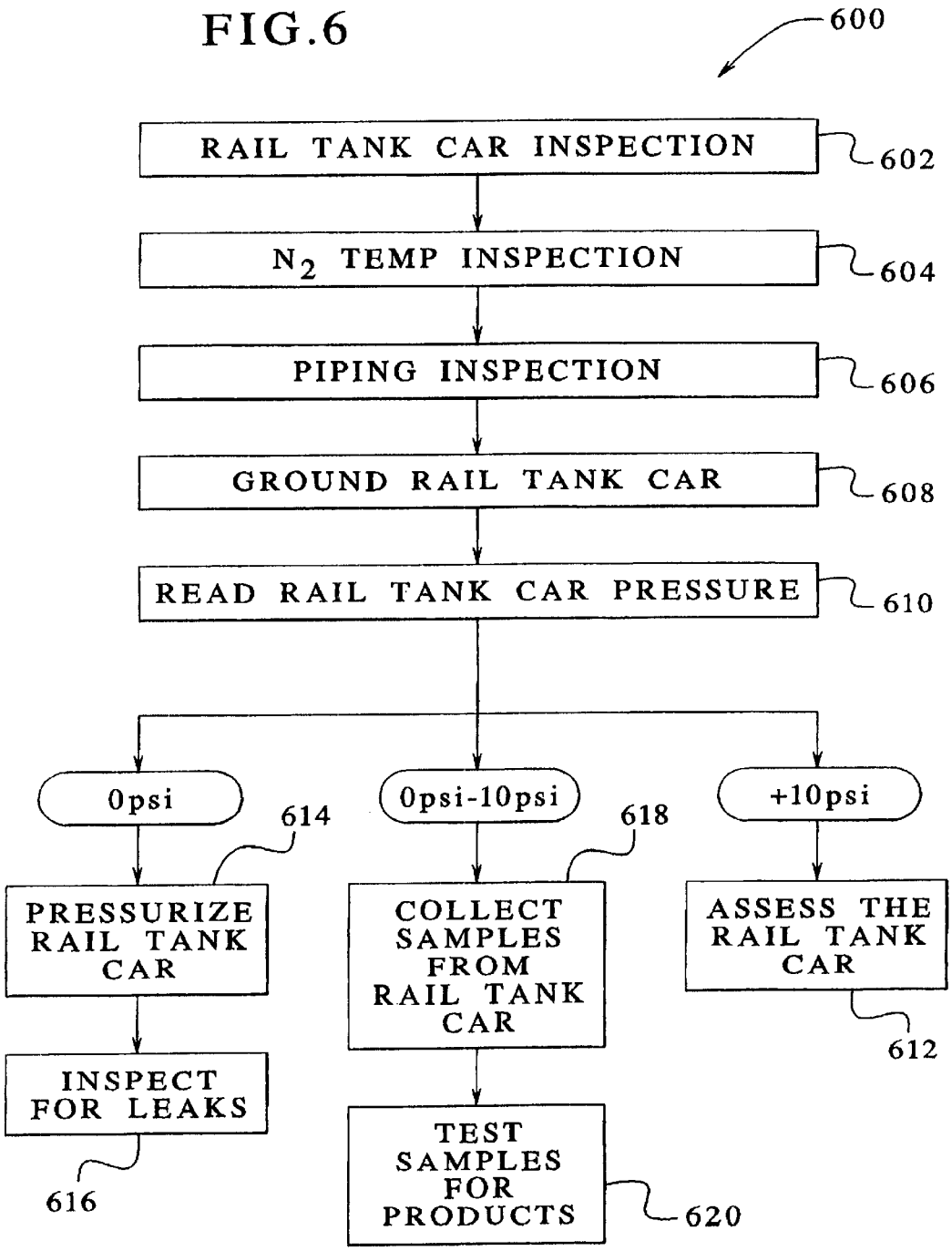
FIG. 6 illustrates an inspection process for pressurized containers containing moisture sensitive chemicals contained therein.

FIG. 6 illustrates an inspection and sampling process 600 that may be performed upon a rail tank car utilizing the systems 500 and 550 as shown in FIGS. 5A and 5B, respectively. The inspection and sampling process 600 may comprise a "Rail Tank Car Inspection" step 602 that may be performed on the rail tank car 502 or any other container that may contain moisture sensitive chemicals such as, for example, chlorine gas and sulfur dioxide gas. An inspector may inspect all valves and fittings that may be attached to the rail tank car 502 for connecting gauges, pipes or any other apparatus or equipment that may be utilized for purging the rail tank car 502 or for otherwise cleaning the chemical out of the rail tank car 502. The inspector may further inspect the threaded connections on any valve or fitting to ensure that all threaded connections have thread sealant to ensure that there are no leaks during the purging and filling of the rail tank car. The inspector, upon performing the inspection and sampling process 600 should wear safety clothing and equipment to protect the inspector from possible leaks of the chemical from within the rail tank car 502, the heated nitrogen gas or air ("input gas") and the reaction tank 522. For example, the inspector may wear gloves such as, for example, neoprene insulated gauntlet gloves, a respirator, flame resistant coveralls or other flame resistant clothing, hearing protection, or any other safety equipment to protect the inspector.

An inspector may also make sure that the temperature of the input gas is at a particular level prior to the gas entering the rail tank car 502 via a "$N_2$ Temperature Inspection" step 604 by testing the temperature of the heater 512, the steam that may be generated by the steamers 514, and/or the nitrogen gas or air after it has flowed through the heater 512. The inspector may, generally, ensure that the temperature of the nitrogen gas or air is at the appropriate temperature. As noted above, the temperature of the nitrogen gas may be between about 100° F. and 300° F., preferably about 200° F. However, the temperature of the input gas may be any temperature that may be apparent to one having ordinary skill in the art to purge the rail tank car 502 of the chemical contained therein. The temperature of the input gas should be hot enough to ensure that no liquid enters the rail tank car, for example in the form of liquid nitrogen, that may freeze the chemical contained within the rail tank car 502 or the pipes and/or equipment thereby causing damage thereto. The system 500 may be manually or automatically shut down if the temperature of the nitrogen gas is either too high or too low. Of course, as noted above, unheated nitrogen gas may be used, although it is preferred that the gas be heated to ensure that no liquid nitrogen enters the system 500.

The piping of the systems 500, 550 may also be inspected via a "Piping Inspection" step 606 to ensure that that there are no cracks, leaks, obstructions or any other damage that may affect the proper operation of the system 500 or 550. A quantity of gas, such as nitrogen gas, air or any other gas, may be injected into the system 500 or 550 and the pressure of the gas may be monitored after the system is closed. If the pressure within the system drops, then a leak may be present. Moreover, instruments or sprays may be used to examine the valves and/or pipes to determine whether there are leaks in the valves or pipes. Moreover, any other equipment may be inspected via step 606 as may be apparent to one having ordinary skill in the art.

The rail tank car may then be grounded via a "Ground Rail Tank Car" step 608 by attaching a ground cable to a ground lug on the rail tank car 502. If the rail tank car 502 does not have a ground lug thereon, then the ground cable may be attached to any bare metal part of the rail tank car 502 or in any other location that may be apparent to one having ordinary skill in the art.

The rail tank car 502 may be weighed during the inspection step 602 to determine the total quantity of the commodity that may be contained within the rail tank car 502. If the tared weight of the rail tank car 502 is preferably about 750 lbs or greater, then the container may be rejected from the cleaning process and sent back to the customer for disposal of the commodity within the rail tank car 502. Of course, any weight may cause the rail tank car 502 to be rejected from the cleaning process as may be apparent to one having ordinary skill in the art.

The pressure of the chemical within the rail tank car 502 may be determined via a gauge that may be attached to the rail tank car 502 via step 610. The gauge may be attached to any of the valves that may access the interior of the rail tank car 502. Preferably, the pressure gauge may be attached to one of the vapor valves. More preferably, a short pipe may be attached to the vapor valve and the pressure gauge may be attached to the short pipe. Moreover, the pressure gauge may be any size and may be able to read any pressure. Preferably, however, the pressure gauge may read up to about 300 psi. When reading the pressure from within the rail tank car 502 via the pressure gauge, the vapor valve may be opened slowly to allow the vapor from inside the rail tank car 502 to pressurize the gauge. The pressure of the chemical within the rail tank car 502 may be recorded in a log and the pressure gauge may be removed from the rail tank car 502.

If the pressure of the rail tank car 502 is greater than a predetermined amount, such as, preferably, about 10 psi, then the rail tank car 502 may be removed from the system 500 or 550 for assessment via step 612. For example, if the rail tank car 502 has a pressure greater than about 10 psi, then there may be a large amount of chemical within the rail tank car 502 and the rail tank car 502 should not be purged and cleaned using the method of the present invention.

However, if the pressure of the rail tank car 502 is 0 psi, then the rail tank car 502 may be pressurized with a small amount of input gas via step 614. The input gas may be added to the rail tank car 502 so that the rail tank car 502 has a predetermined level of input gas therein so that a reading of the quantity of chemical contained therein may be performed. Preferably, the rail tank car 502 may be pressurized to about 6 psi so that a sample may be withdrawn and the rail tank car 502 may be inspected for leaks. To fill the rail tank car 502, the input pipe 504 may be attached to a valve on the rail tank car 502 to allow access to the interior of the rail tank car 502. Preferably, the input pipe 504 is attached to the liquid valve 408. Moreover, the pressure gauge may remain attached to the vapor valve 410 so that the pressure within the rail tank car 502 may be monitored. The liquid valve 408 may be opened to allow the heated input gas to enter the rail tank car 502. After the pressure has reached a predetermined level, such as, for example, about 6 psi, the liquid valve 408 may be closed. The rail tank car 502 may then be inspected for leaks via step 616. More specifically, a Draeger meter or any other instrument may be utilized to inspect the rail tank car for leaks. Alternatively, a test may include spraying an ammonia/water mixture over valves, pipes or other areas of the system 500 if the rail tank car 502 contains chlorine gas. If the solution turns yellow-green, then a leak may be present at the valves, pipes, or other areas of the system 500.

After the rail tank car 502 has been pressurized via step 614 and/or inspected via step 616, or if the pressure within the rail tank car is measured at above 0 psi but lower than the predetermined level such as, for example, about 10 psi, then a sample of the content of the rail tank car 502 may be collected via step 618. The sample may then be tested via step 620. The sample may be removed and tested via any method and by any equipment that may be apparent to one having ordinary skill in the art. Preferably, however, a Draeger meter may be utilized to test the chemical. More preferably, any of the valves may be tested for the chemical. A short pipe may be attached to the particular valve being tested. The valve may be opened to allow a small quantity of the chemicals within the rail tank car 502 to flow into the Draeger meter. The sample may be used to verify the type of chemical within the rail tank car 502 or for any other reason that may be apparent to those having ordinary skill in the art.

Figure 7:
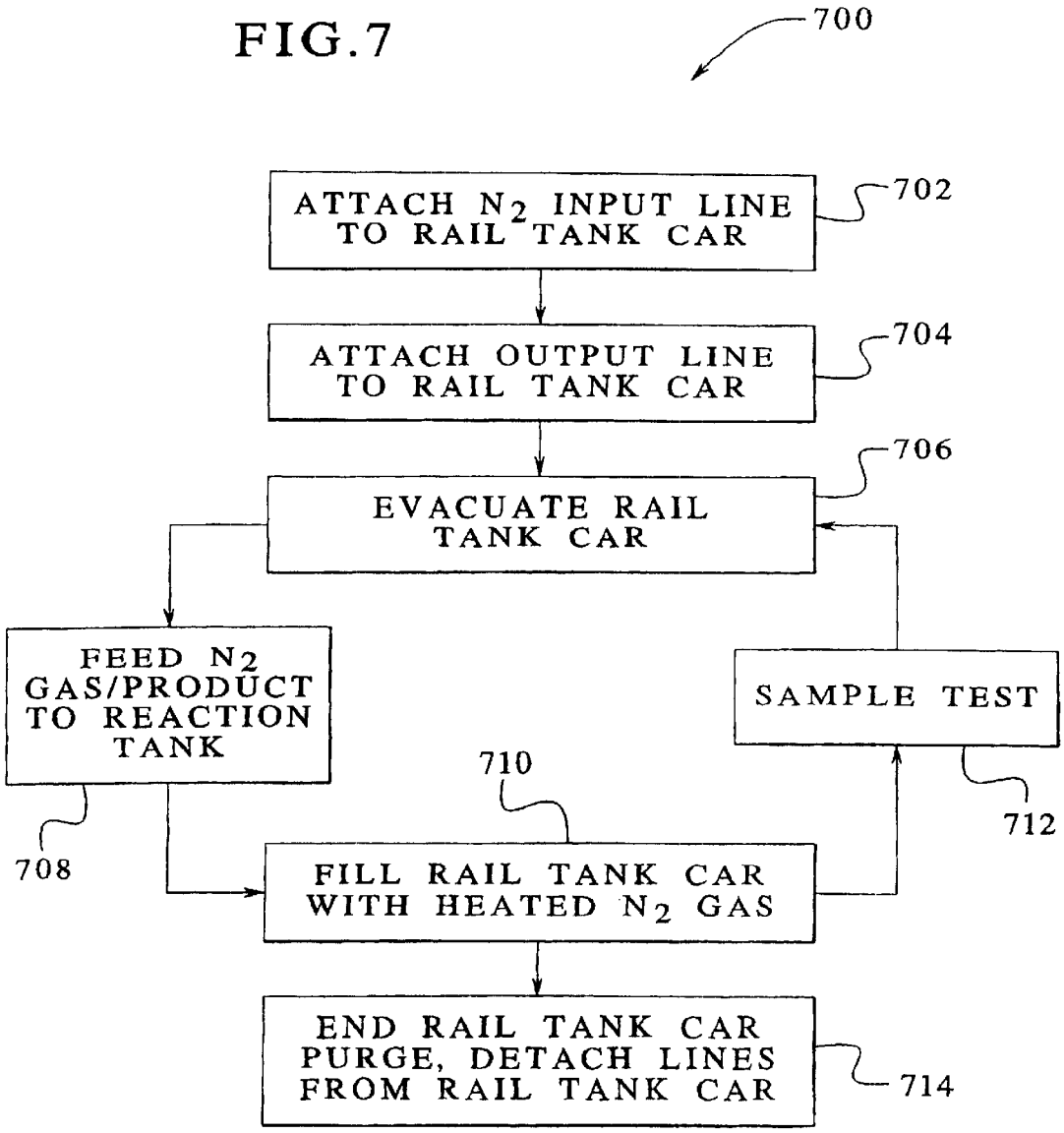
FIG. 7 illustrates a cleaning process for the pressurized containers containing moisture sensitive chemicals therein.

After the inspection and sampling of the chemical are completed via the process 600 as shown in FIG. 6, the rail tank car 502 may be cleaned via a cleaning process 700, as shown in FIG. 7. Generally, the rail tank car 502 may be hooked up to the input pipe 504 via step 702. Further, the output pipe 516 may be attached to the rail tank car via step 704. Preferably, the input pipe may be connected to the liquid valve 408, while the output pipe 516 may be attached to one of the vapor valves 410. This may ensure that the heated input gas enters the rail tank car 502 and flows to the bottom of the rail tank car 502 and out of the rail tank car 502 at the top of the rail tank car 502 via the vapor valve 410. This may further ensure that the heated input gas circulates fully within the rail tank car 502. However, the input pipe 504 and the output pipe 516 may be attached to the rail tank car 502 in any manner apparent to one having ordinary skill in the art. Moreover, the input pipe 504 and the output pipe 516 may be subdivided so as to be attached to a plurality of valves on the rail tank car 502. This may allow the cleaning process 700 to be done faster than if attached to only one valve each, respectively.

After the input pipe 504 and output pipe 516 are attached to the rail tank car 502, an operator may evacuate the rail tank car 502 via step 706 by turning the vacuum pump 518 on while keeping the input pipe 504 closed and the output pipe 516 open. The vacuum pump may evacuate the rail tank car 502 to a predetermined level such as, preferably, to about −25 mm Hg, or any other level apparent to one having ordinary skill in the art. The chemicals within the rail tank car 502 may be pulled via the vacuum and may flow to the reaction tank 522 via step 708. When the vacuum pump 518 reaches the predetermined level, the vacuum pump 518 may shut off and the vapor valve 410 or the output valve 534 may be closed. At this point, the liquid valve 408 or the input valve 532 may be opened allowing the heated input gas to flow into the rail tank car 502 via step 710. When the pressure within the rail tank car 502 reaches a predetermined level, such as, preferably, atmospheric pressure, the liquid valve 408 may be closed. The vapor valve 410 or the output valve 534 may be opened and the vacuum pump 518 may be turned on to repeat step 706. Steps 706, 708 and 710 may be repeated a plurality of times until the level of the chemical within the rail tank car 502 reaches a certain level. Alternatively, steps 706, 708 and 710 may be repeated a predetermined number of times, such as, for example, eight cycles, to ensure that the chemical within the rail tank car 502 has been removed from the rail tank car 502. After the rail tank car 502 has been filled with heated input gas, the concentration of the chemical contained therein may be measured via a "sample test" step 712. When the concentration of the chemicals within the rail tank car 502 reaches a certain level, then the purging of the rail tank car 502 may be ended and the lines may be detached from the rail tank car 502 via step 714.

For example, if the rail tank car 502 contains chlorine gas therein, then steps 706, 708 and 710 may be repeated until the concentration of chlorine gas within the rail tank car 502 reaches about 0.5 parts per million, or any other concentration that may be apparent to one having ordinary skill in the art. This may typically take up to 6 or 8 cycles of steps 706, 708 and 710, however, any number of cycles may be performed to reach the desired concentration level of chlorine gas. Moreover, if sulfur dioxide gas is contained within the rail tank car 502, then the steps 706, 708 and 710 may be repeated a plurality of times so that the concentration of sulfur dioxide gas reaches about 2 parts per million, or any other level apparent to one having ordinary skill in the art. Of course, the number of cycles necessary will vary depending on the desired level of cleanliness of the rail tank car 502.

The chemicals contained within the rail tank car 502 may be sent to the reaction tank 522 to react with the chemicals contained therein to form harmless substances such as, for example, NaCl salt, as noted above by reacting with NaOH, or any other neutralizing chemical.

It should be noted that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A system for cleaning pressurized containers containing chemicals comprising:

a pressurized container having a quantity of chemicals therein wherein the pressurized container has a plurality of valves for attaching a plurality of pipes thereto;

a nitrogen gas storage tank wherein the nitrogen gas storage tank is attachable to a first valve on the container for feeding nitrogen gas into the pressurized container to intermix with the quantity of chemicals contained within the pressurized container to form a nitrogen gas and chemical mixture; and a tank comprising a neutralizing material connected to the container via a first pipe for receiving the nitrogen gas and chemical mixture.

2. The system of claim 1 further comprising a vacuum pump disposed between the container and the tank comprising the neutralizing material for pumping the chemicals from the container to the tank comprising the neutralizing material.

3. The system of claim 1 further comprising a heat exchange means connected to the nitrogen gas storage tank via a second pipe wherein nitrogen gas within the second pipe is heated by the heat exchange means.

4. The system of claim 1 wherein the plurality of valves regulates a flow of nitrogen gas from the nitrogen gas storage tank and the container.

5. The system of claim 1 wherein the container is a railcar.

6. The system of claim 1 wherein the container is disposed on a vehicle.

7. The system of claim 3 further comprising:

a heating means connected to the heat exchange means for feeding a fluid to the heat exchange means for heating nitrogen gas that flows through the heat exchange means.

8. The system of claim 3 further comprising:

a nitrogen vaporizer attached to a second section of the first pipe for vaporizing the nitrogen from the nitrogen storage tank.

9. The system of claim 1 further comprising:

a first pipe within the container and attached to a valve wherein the first pipe within the container extends to a bottom of the container.

10. The system of claim 1 further comprising:

a pipe within the container and attached to a valve and extending partially within the container.

11. The system of claim 1 further comprising:

a controller interconnected with the plurality of valves for controlling the opening and closing of the valves.

12. The system of claim 2 further comprising:

a controller interconnected with the plurality of valves and the vacuum pump for controlling the opening and closing of the valves and for controlling the operation of the vacuum pump.

13. The system of claim 12 wherein the controller controls the opening and closing of the plurality of valves in synchronization with the vacuum pump.

14. The system of claim 1 further comprising:

a gauge attached to the container for measuring the internal pressure of the container.

15. The system of claim 1 wherein the tank comprises a quantity of a material selected from the group consisting of sodium hydroxide, potassium hydroxide, sodium carbonate, calcium hydroxide, sodium sulfite, sodium thiosulfite, ferrous chloride and solid bed absorbents.

16. The system of claim 1 wherein the tank neutralizes chlorine gas and sulfur dioxide gas.

17. The system of claim 2 wherein a second pipe extends from the container to the vacuum pump and further wherein a third pipe extends from the vacuum pump to the tank comprising the neutralizing material.

18. A system for cleaning pressurized containers containing chemicals comprising:

a pressurized container having a quantity of chemicals therein wherein the container has a plurality of valves for attaching a plurality of pipes thereto;

an intake means for blowing air into the container via a first pipe for mixing the air with the quantity of chemicals to form an air and chemical mixture; and a tank comprising a neutralizing material connected to the container via a second pipe for receiving the air and chemical mixture.

19. The system of claim 18 wherein the intake means comprises a fan.

20. The system of claim 18 wherein the air is regulated into the container via a first valve wherein the first valve is connected to a controlling means.

21. The system of claim 18 further comprising:

a pressure gauge attached to one of the plurality of valves for measuring the pressure within the tank.

22. The system of claim 18 further comprising:

a control panel having a plurality of switches for controlling the system.

23. The system of claim 18 wherein the tank comprises a quantity of a material selected from the group consisting of sodium hydroxide, potassium hydroxide, sodium carbonate, calcium hydroxide, sodium sulfite, sodium thiosulfite, ferrous chloride and solid bed absorbents.

24. The system of claim 18 wherein the tank neutralizes chlorine gas and sulfur dioxide gas.

25. The system of claim 18 further comprising a vacuum pump disposed between the container and the tank for pumping the chemicals from the container to the tank.

26. The system of claim 25 wherein a third pipe extends from the container to the vacuum pump and further wherein a fourth pipe extends from the vacuum pump to the tank containing the neutralizing material.

27. The system of claim 18 further comprising a third pipe attached to the intake means and further wherein a heating means is attached to the third pipe for heating air flowing through the third pipe.

28. The system of claim 18 further comprising a third pipe attached to the intake means and further wherein a drying means is attached to the third pipe for drying the air flowing through the third pipe.

29. A system for cleaning pressurized containers containing chemicals comprising:

a container having a quantity of chemicals therein wherein the container has a plurality of valves for attaching a plurality of pipes thereto;

a nitrogen gas storage tank wherein the nitrogen gas storage tank is attachable to a first valve on the container;

a tank comprising a neutralizing material connected to the container via a first pipe;

a heat exchange means connected to the nitrogen gas storage tank via a second pipe wherein nitrogen gas within the first pipe is heated by the heat exchange means; and a heating means connected to the heat exchange means for feeding a fluid to the heat exchange means for heating nitrogen gas that flows through the heat exchange means.

30. A system for cleaning pressurized containers containing chemicals comprising:

a container having a quantity of chemicals therein wherein the container has a plurality of valves for attaching a plurality of pipes thereto;

a nitrogen gas storage tank wherein the nitrogen gas storage tank is attachable to a first valve on the container; and a tank comprising a neutralizing material connected to the container via a first pipe wherein said neutralizing material is selected from the group consisting of sodium hydroxide, potassium hydroxide, sodium carbonate, calcium hydroxide, sodium sulfite, sodium thiosulfite, ferrous chloride and solid bed absorbents.

31. A system for cleaning pressurized containers containing chemicals comprising:

a container having a quantity of chemicals therein wherein the container has a plurality of valves for attaching a plurality of pipes thereto;

a nitrogen gas storage tank wherein the nitrogen gas storage tank is attachable to a first valve on the container; and a tank comprising a neutralizing material connected to the container via a first pipe wherein said tank neutralizes chloride gas and sulfur dioxide gas.

32. A system for cleaning pressurized containers containing chemicals comprising:

a container having a quantity of chemicals therein wherein the container has a plurality of valves for attaching a plurality of pipes thereto;

a nitrogen gas storage tank wherein the nitrogen gas storage tank is attachable to a first valve on the container;

a tank comprising a neutralizing material connected to the container via a first pipe; and a vacuum pump disposed between the container and the tank containing the neutralizing material for pumping the chemicals from the container to the tank wherein a second pipe extends from the container to the vacuum pipe and further wherein a third pipe extends from the vacuum pump to the tank containing the neutralizing material.

33. A system for cleaning pressurized containers containing chemicals comprising:

a container having a quantity of chemicals therein wherein the container has a plurality of valves for attaching a plurality of pipes thereto;

an intake means for blowing air into the container via a first pipe; and a tank comprising a neutralizing material connected to the container via a second pipe wherein said tank comprises a quantity of a material selected from the group consisting of sodium hydroxide, potassium hydroxide, sodium carbonate, calcium carbonate, sodium sulfite, sodium thiosulfite, ferrous chloride, solid bed absorbents and mixtures of these materials.

34. A system for cleaning pressurized containers containing chemicals comprising:

a container having a quantity of chemicals therein wherein the container has a plurality of valves for attaching a plurality of pipes thereto;

an intake means for blowing air into the container via a first pipe; and a tank comprising a neutralizing material connected to the container via a second pipe wherein said tank neutralizes chlorine gas and sulfur dioxide gas.

35. A system for cleaning pressurized containers containing chemicals comprising:

a container having a quantity of chemicals therein wherein the container has a plurality of valves for attaching a plurality of pipes thereto;

an intake means for blowing air into the container via a first pipe;

a tank comprising a neutralizing material connected to the container via a second pipe; and a vacuum pump disposed between the container and the tank for pumping the chemicals from the container to the tank, wherein a third pipe extends from the container to the vacuum pump and further wherein a fourth pipe extends from the vacuum pump to the tank comprising the neutralizing material.

* * * * *